United States Patent [19]

Kirchhan

[11] Patent Number: 4,546,874

[45] Date of Patent: Oct. 15, 1985

[54] CONTAINER AND SEALING ENCLOSURE

[76] Inventor: James J. Kirchhan, 23912 Flores Ave., Laguna Niguel, Calif. 92677

[21] Appl. No.: 584,142

[22] Filed: Feb. 27, 1984

[51] Int. Cl.[4] ..... B65D 6/28; B65D 6/32; B65D 6/34

[52] U.S. Cl. ..... 220/4 B; 220/80; 220/81 R

[58] Field of Search ..... 220/4 B, 80, 81 R

[56] References Cited

U.S. PATENT DOCUMENTS

| | | | |
|---|---|---|---|
| 2,428,371 | 10/1947 | Kinberg | 220/81 R |
| 2,951,613 | 9/1960 | Hardigg | 220/81 R |
| 3,044,658 | 7/1962 | Combs | 220/81 R |
| 3,088,623 | 5/1963 | Parker | 220/4 B |
| 3,128,855 | 4/1964 | Hoffmann | 220/4 B |
| 3,276,657 | 10/1966 | Speas | 220/80 |

*Primary Examiner*—George E. Lowrance

*Attorney, Agent, or Firm*—George F. Bethel; Patience K. Bethel

[57] ABSTRACT

The following specification discloses a container such as a box, packing or shipping container for items that are to be maintained in a vapor proof environment. The container is made out of a sheetlike material, such as plastic derived from one of the olefin family of plastics. It is formed with bumpers, guards, and reinforcing and expanded portions of the case for protection and reinforcement thereof. The sealing and closure means comprise a pair of channel members that are secured over the edge of the walls of the container. One of the channel members provides an elongated depressed seat for an elastomeric seal therein, and the second channel member provides a mating tongue that seats against the elastomeric seal. Both of the channel members are hinged, latched or clamped together with the edge regions of the container walls lying within the channels. The channels have barbs or tangs which impinge against the container wall portion. The barbs are on opposite channel walls and are offset against said wall portion. This provides a bending moment to the container wall and a sealing of the wall portion against the barbs or tangs. The container wall section is further sealed in the channel by means of a non-hardening sealant.

19 Claims, 8 Drawing Figures

10
16
12
18
14
2
24
30
22
2
32
20
38

56
46
30
8
42
8
94
64
120
50
34
38
112
102
110
106
36
120
52
96
32
44
58
48

34

42
76
46
72
94
80
90
84
98
51
47
100

106
110
53
49

108
92
82
96
86
78
36
44
48
74

CONTAINER AND SEALING ENCLOSURE

BACKGROUND OF THE INVENTION

1. Field of the Invention

The field of this invention lies within the art of containers that are moisture proof to provide a moisture proof environment for items implaced therein. The specific field is with regard to containers having edge regions that seal the container together in the form of fixtures around the edges thereof that come together to provide a closure.

2. The Prior Art

The prior art of containers that are substantially moisture proof involves a number of ways of sealing the container. Oftentimes, the container is sealed by means of an overlapping lip, or channel members that are respectively male and female elongated channel members that come together.

The channel members are oftentimes held together in a compressed mode by overcenter locks or latches. When using such overcenter locks or latches, the channel members are brought into close juxtaposition to each other and sealed with each other by a frictional sealing engagement.

It has been customary in the past to use closures in the form of elastomeric O-rings or devices which provide for various members forming an elastomerically compressed mode. This enhances the entire function of the channel members so that not only is a frictional engagement provided, but also an elastomeric seal that has been compressed.

In the past, such means have been relatively inadequate in preventing a long term escape of gas or preventing the incursion of moisture through the seal or the channel members.

The incursion or penetration of moisture has taken place due to the fact that the seal between the wall of the container and the channel member has not oftentimes been sufficient. As can be understood, when certain items are placed in tight juxtaposition, especially when they are plastic and metal, they tend to not adhere to each other. This is particularly true when a metallic channel member is used, and a plastic member is seated therein, which forms the wall of the container. The channel member tends to only grip the wall portion with sufficient strength with the frictional engagement that it has therewith for a limited period of time. When a flowable sealant is used, the sealant oftentimes is displaced and does not provide a sufficient sealant between the channel member and the wall of the container.

The inventor has found that in order to obtain a proper seal and grip between the container wall members and the metallic channel members; that a cold flow of the plastic walls can be utilized. This is provided by a displacement of the wall members in the way of an offset modulus or bending moment provided thereto. This is particularly enhanced by the fact that the offset modulus or bending moment causes a cold flow or creep against the structure that the inventor has invented.

The inventor has found that to avoid the lack of a seal and grip between a metal channel and the container wall member, the wall member can be displaced through a bending moment provided by the channel having a barb or tank therein. The barb or tang can be displaced from at least one or more barbs or tangs on the other side of the channel so as to allow for a modulus of stress to cause the wall member to cold flow against the barb of the channel.

The foregoing is particularly enhanced by a crimping of the metal channel against the container wall structure that causes a bending moment to be applied against an opposite elongated barb or tang. This causes an implacement of the barb or tang into the plastic and a general cold flow therearound.

A non-hardening sealant is implaced within the channel in which the wall portion is received. The non-hardening sealant assures proper sealing while the displaced wall from its offcenter relationship through its bending moment creates a situation wherein the wall is not only secured in the channel, but provides for a cold flow sealed relationship therewith.

The foregoing channel members seal the container by an elastomeric gasket within a rounded elongated groove in one of the channel members. This in turn is sealed against the other channel member by virtue of a tongue in the form of a pyramid cross sectionally shaped member sealing against the gasket.

In order to prevent the channel members from allowing the passage of gas at their weld point around their elastomeric seal member, a flow of sealant is provided through an opening to seal the gasket in its elongated rounded groove or seat.

The channel members are connected together by means of a hinge, latches or clamps which are expanded into the channel member. This holds the hinge, latches or clamps to the channel member in the manner to be described hereinafter.

All the foregoing features, including the displacement of the container wall portion providing the bending moment, the cold flow of the plastic container wall, the non-hardening sealant, and the prevention of leakage through the weld point of the channel members enhance and provide singular and combined features to make this a substantial step over the prior art in the manner described hereinafter.

SUMMARY OF THE INVENTION

In summation, this invention comprises a closure for a generally vapor proof reusable container having hinges, latches or clamps and in particular, a sealing means and holding means between the walls of the container and channelized members around the edge of the container.

More specifically, it comprises a pair of channel members for seating around the periphery of the edges of the walls of a container. The channel member specifically is seated with its channel overlying the wall portion of the container and has a male and female interfacing seal portion. The female seal portion is specifically a rounded groove or a lesser round channel for receiving an elastomeric seal or elongated O-ring therein. The male seal portion is a triangular tongue, spline or flange that seats against the elastomeric portion of said female channel portion.

The two respective channel members are hinged, clamped or latched to each other along an outside portion thereof in order to allow the container to be opened and closed along said connection point. Said hinge, latch or clamp is engaged by the channel members by rivets, or other suitable attachments. It can also be in one particular embodiment of this invention, joined by means of expanding the hinge, latch or clamp into overlapping flanges providing an undercut which receives the connections expanded thereinto.

A unique portion of this invention resides within the seating of the container wall section within the channels. The seating of the container wall section into the channels specifically relies upon an initial bending moment applied to the wall section. The initial bending moment at a particular location causes a force vector to push the end of the wall portion against an elongated barb or tang. The elongated barb or tang allows for a cold flowing of the plastic of the walls to flow thereover and to be seated so as to provide for a seal and gripping of the container walls.

The tangs or barbs can be in the form of one or more barbs on one interior side of the channel and one or more barbs on the other interior side. They are displaced along the interior of the channel so as to permit a bending moment to be applied against the container wall and the consummate cold flow and implacement of the wall against one of the tangs or barbs to permit a seal or grip of the wall in the channel. This is enhanced by means of crimping the channel after the plastic container wall is inserted therein. This applies a force for causing the bending vectorial force consummating in the overall spring action or bending moment of the plastic. The wall in the channel is finally sealed with a non-hardening sealant therein so as to prevent the passage of moisture into the container.

The foregoing channel members are formed from an extruded strip providing the channel, flanges, barbs and grooves. The extruded strip is welded at one particular portion. At the particular weld point, the interior of the channel cannot be sufficiently welded in most cases to prevent gas leakage around the gasket. Accordingly, a means for allowing the passage of sealant to flow against the gasket to prevent leakage therearound is provided for at the weld point which is another novel aspect of this invention.

In final summation, the invention comprises a new and novel pair of channel members that seat on the edge portion of a container wall. The channels seal and grip the edge portion of the container as well as creating a novel sealant. The invention provides a means for allowing a sealed weldment of the extruded strip forming the channel members while at the same time providing for a hinge, latch or clamp placement within the exterior flanges of the channel members. The foregoing is a distinct advantage for a sealed container over the prior art.

DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
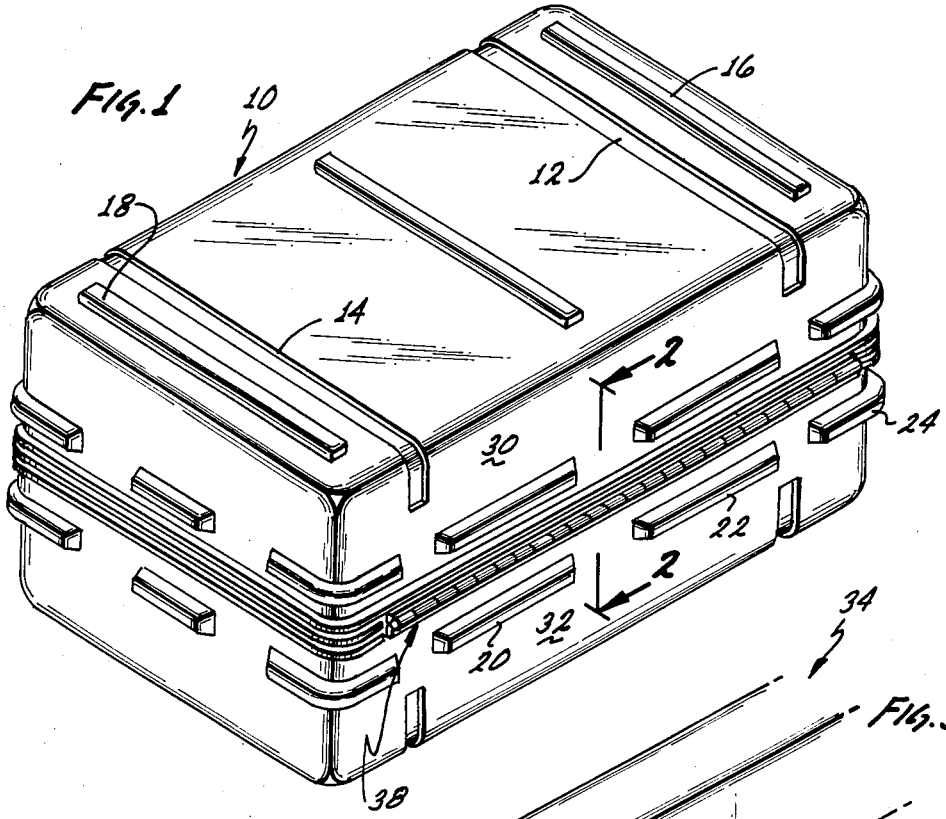
FIG. 1 shows a perspective view of a container and the closure and sealing means of this invention, looking from the hinge portion thereof.

Looking at FIG. 1, it can be seen that a container 10 is shown. The container can be made out of malleable metal such as an aluminum, or even steel. In this case, it is preferably made out of a plastic material which is formed through certain standard molding operations, such as blow molding, rotational molding, or any other kind of forming operation. Preferably, the material from which the container is made is from a plastic of the olefin family. Such plastics as polyethylene can be utilized.

It is preferred that a high molecular weight or density polyethylene be utilized. The high molecular weight polyethylene generally prevents crazing and cracking due to the increased density. The high molecular weight material helps to prevent the cracking as well as performing the function of preventing the passage of moisture into the container 10.

It should be understood that the container in this particular instance is generally a container for sealing parts from moisture therein and should be formed of a material that is not hygroscopic in order to eliminate the transmission of moisture therethrough.

Oftentimes, these containers are used to seal such items as electronic and mechanical instrumentation. Such instrumentation is required to be kept in a moisture free environment for both industrial and military uses. Accordingly, the limited transmission of moisture is extremely important in this case, and the design of the container from the standpoint of the transmissibility of the plastic is an important consideration herein.

Looking more particularly at the container, it can be seen that a number of reinforcing members and bumpers have been provided. Also, channels 12 and 14 are provided which circumscribe the container.

Expanded glides on the major surfaces 16 and 18 are shown. The expanded glides 16 and 18 allow for the container to be rested and moved on one major surface or the other. When the container is in an upright position, a plurality of spaced bumpers 20, 22, and 24 at the curved portion, are provided. These spaced bumpers provide for a rest point while at the same time protecting the hinge and the closure means as described hereinafter.

Figure 2:
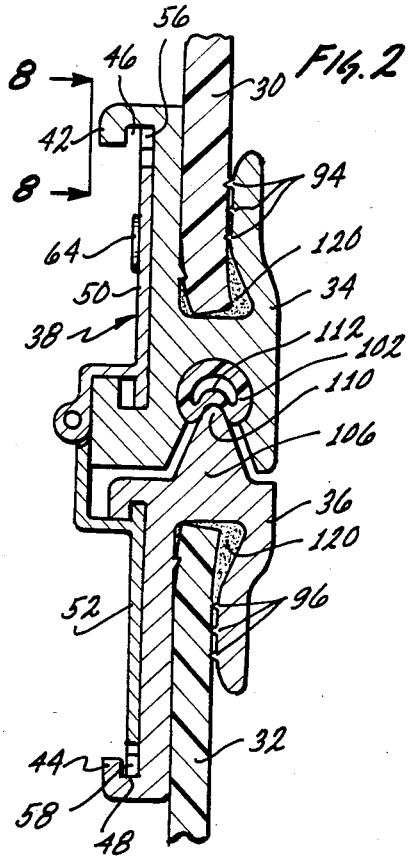
FIG. 2 shows a section of the channel members and their engaging relationship when closed, in the direction of lines 2—2 of FIG. 1.
Figure 3:
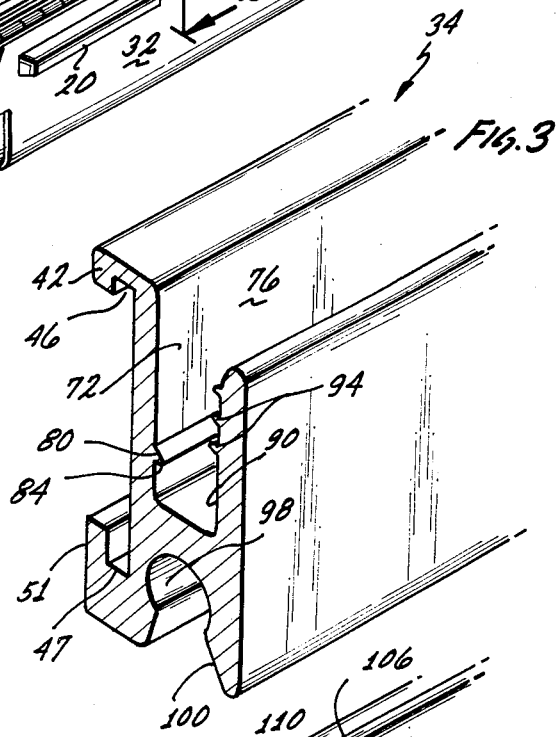
FIG. 3 shows a fragmented perspective view of the channel member having the female groove for receipt of the gasket therein.
Figure 4:
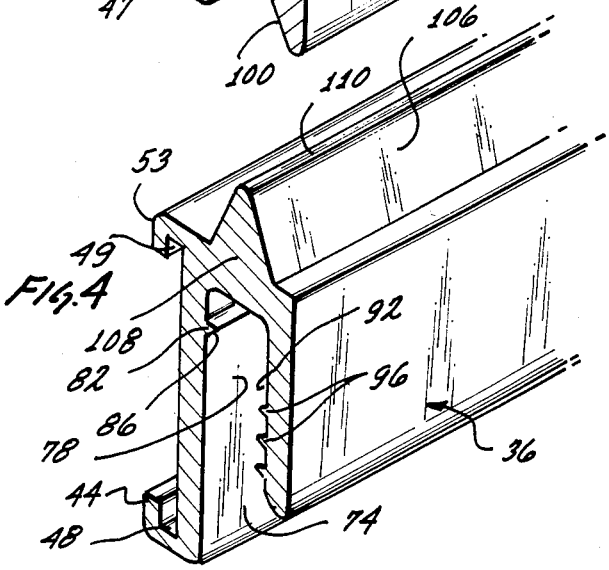
FIG. 4 shows a fragmented perspective view of the channel member having the male portion or tongue thereon for seating within the groove of the female portion of FIG. 3.

Looking more particularly at the closure means in the direction of lines 2—2, it can be seen in FIG. 2 that container walls 30 and 32 are respectively seated in channel members 34 and 36. The channel members 34 and 36 receive the walls 30 and 32 in roughly the same manner.

Both of the channel members 34 and 36 are hinged, latched or clamped together by means of hinges, latches or clamps 38, that are described hereinafter. The hinge 38 is in particular, a hinge which secures the channel members in their configured relationship as shown.

Each channel has a spline or flange respectively 42 and 44 which extends along the length thereof. The flanges 42 and 44 each provide for an elongated undercut or grooves 46 and 48. The undercut or grooves 46 and 48 allow for the plate 50 and 52 of the hinge to be expanded and seated in the undercuts 46 and 48. A further pair of undercuts or channels 47 and 49 provided by flanges 51 and 53 provide a seating to the expanded hinge plates 50 and 52. The expanded hinge portions allow for a tightened juxtaposed relationship within the grooves 46 and 48, and undercuts 47 and 49, as can be seen at points 56 and 58.

Expanded portions 56 and 58 are such that they are initially a portion of the hinge in the form of an opening 62. The opening 62 allows for a tool to expand against the hinge portion interior opening 62 to push the edge region or hinge portion 56 upwardly such that it provides a locking or protuberance expanded into the groove 46 behind the spline or flange area of flange 42. This expanded portion 56 is sufficiently drawn to provide for a tight locking. In like manner, the hinge is expanded into grooves 47, 48 and 49. Other means for attaching the hinge 38 can be utilized such as by having a rivet 64 connecting the hinge to the channel members 34 and 36.

In addition to the foregoing, the rivet 64 can be used even when the expanded portions 56 and 58 are utilized in order to index the placement of the hinge 38.

When the metal of the hinge 38 is expanded at the opening 62 upwardly, it allows for a frictional locking of the expanded portion 56 or protuberance tightly up against the interior 46 of the flange 42. This accommodates any movement of the hinge and prevents both longitudinal and axial displacement within the channel members.

Looking more particularly at the channel members 34 and 36, it can be seen wherein the channel members comprise substantially similar interior major channels 72 and 74. The major channels 72 and 74 are formed during an extrusion process. On walls 76 and 78 of the channels, an elongated tang or barb respectively 80 and 82, is provided and the tang or barb 80 and 82 creates a situation wherein the points 84 and 86 of the barbs engage the plastic of the wall of the container, namely walls 30 and 32.

On the inside wall of the channel members 30 and 32, namely walls 90 and 92, a plurality of barbs 94 and 96 are shown. These barbs 94 and 96 function and interact with the barbs 80 and 82, in the manner to be described hereinafter with respect to FIGS. 5 and 6. To function properly they are displaced in depth from each other in the channels so that barbs 94 and 96 are placed in the channels at a greater or lesser distance therein than barbs 80 and 82.

Looking more particularly at the respective channel members 34 and 36, it can be seen that a rounded interior groove 98 is shown in the form of a rounded opening having a wall portion 100 expanding outwardly therefrom. The rounded opening 98 with the expanded wall portion 100 permits the seating of an elastomeric O-ring, gasket or seal 102 therein. This expanded wall portion 100 allows for the displacement downwardly of the O-ring 98 so as to accommodate the elastomeric nature thereof when a spline, tongue or flange 106 is seated thereagainst.

The spline, flange or tongue 106 is formed with a triangular or pyramid cross sectional shape 108 so that a rounded top portion 110 thereof seats into the expanded wall portions 100 and compresses the elastomeric material of the seal or gasket 102 in a manner as shown in FIG. 2. This thereby provides for a compressive action of the interior 112 of the seal or gasket 102 so that a tightened fit is provided between the edge 110 of the tongue 106 and the seal.

Figure 5:
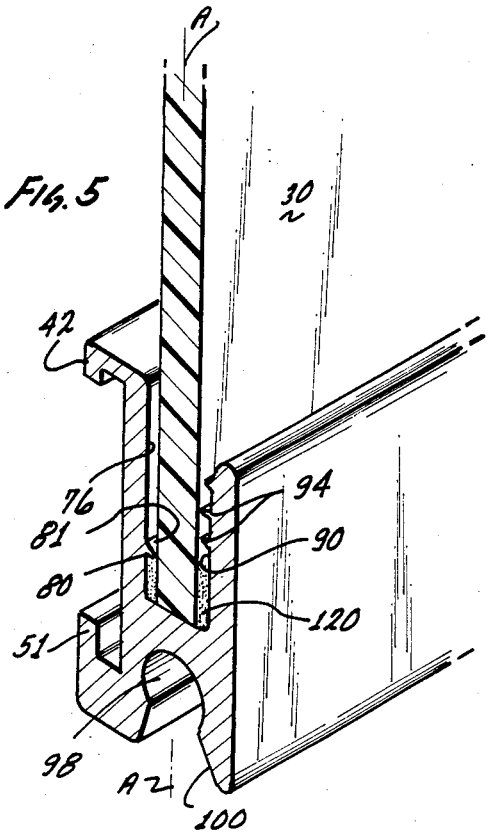
FIG. 5 shows a fragmented sectional perspective view of the seating of the wall of the container within the channel prior to being secured therein.
Figure 6:
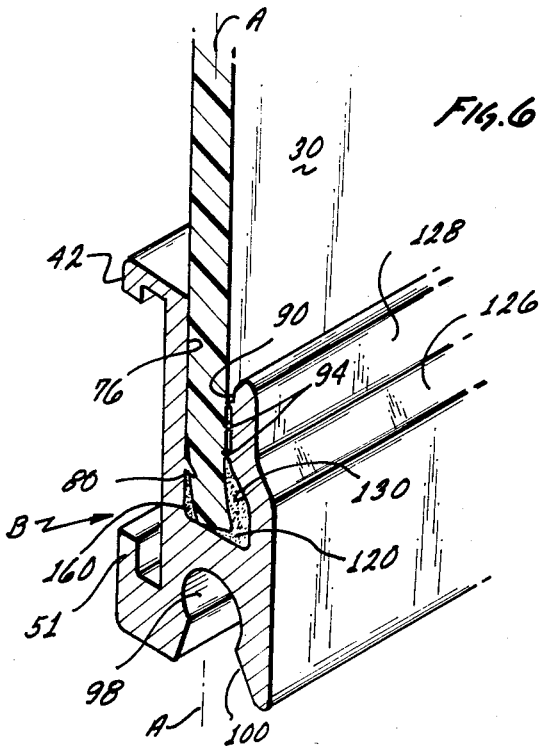
FIG. 6 shows the wall of the container after it is seated in the channel and as it is secured therein with the channel being crimped for securement of the wall.
Figure 8:
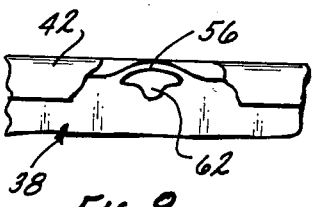

Looking more particularly at FIGS. 5 and 6, it can be seen wherein the wall portion 30 has been seated within the opening of the channel. It is initially seated therein in a manner to provide for clearance for compressing engagement of tangs or barbs 92 and 96.

As can be seen in FIG. 5, the sheet or side panel 30 of the container 10 has been placed in the channel 72 between walls 76 and 90. The thickness of the plastic can range to the point where contact is relatively loosely implaced against the barbs 80 and 94.

A non-hardening adhesive or sealant in the form of an elastomeric sealant 120 is implaced in the channel for vapor barrier sealing purposes. This sealant serves to form a vapor barrier in conjunction with the remaining portion of the invention as will be described hereinafter. The thickness of the wall or plastic material 30 can range from 0.070 inches to 0.180 inches in thickness.

The barbs 94 can be sharpened barbs having any particular facing angle of the barb. However, in some cases it has been found that a certain barb will provide a particular characteristic with regard to a plastic material superior to another. This is within the capability of design as to various plastics.

The single barb 80 has a face of approximately thirty degrees or a lead angle of thirty degrees across its face 81. Any particular barb conformation can be utilized, as long as it allows the entry of the edge region of the sheet 30 for placement within the channel.

After the sheet 30 has been implaced in the channel, the channel wall 90 is crimped toward the wall 76. This crimping action can be seen in FIG. 6 wherein the bend or crimp at bend 126 is shown providing an upright portion 128 driven in the direction of the sheet 30. The upright portion 128 is driven a distance shown by the angle of inclination across the sloping interior edge 130 when bent so as to provide the crimp whereby the wall 128 moves snugly against the sheet 30.

The foregoing action creates a situation wherein a bending moment is applied to that sheet 30. This bending moment can be seen such that the axis of the sheet 30 along line A—A is such that the sheet moves angularly toward the interior of the channel member.

Based upon the force bending moments, the sheet 30 bends so that the reverse forces cause the sheet to impinge against the barb 80. This bending moment of the sheet along its axis A—A backwardly toward the barb 80 causes the barb to penetrate the sheet 30.

The penetration of the barb 80 into the sheet provides for a cold flow of the plastic around the barb 80. This cold flow creeps and causes a flow of the plastic around the barb 80. The foregoing creates not only a holding and retention action, but also helps to seal the wall 30 within the channel.

It should be understood that one or more barbs or tangs can be utilized, such as barb 80, or barbs 94. It is not necessary to only have the specific configuration. If the crimp 128 can provide the force against barbs 80 or 82, it is not always necessary to employ barbs 94 and 96 to provide the offset bending force. In other words, any means to provide a bending force through axis A—A against a barb such as barbs 80 and 82, can cause the desired cold flow grip and sealing of the channels against wall 30. The desired effect is by providing a barb that will allow cold flow thereover by means of an offset barb or protuberance on the opposite wall, such as the barbs 94. This provides for a driving of the sheet 30 due to the bending moment force against the barb 80 for the cold flow and retention as previously set forth.

The foregoing principle is that an offset bending moment causes the sheet to bend along the axis A—A thereof through the crimping action or the driving of a protuberance or any other means, of the interior wall 90, so as to offset the axis of the sheet 30 and bend it against the barb or tang 80. Accordingly, this invention should not be read narrowly to construe only the specific barb configuration. It should be read broadly so as to apply any kind of penetration or protuberance substituted for the barb 80 and a second means for providing on the opposite wall a force in order to drive it over the barb in an offset bending moment relationship.

Figure 7:
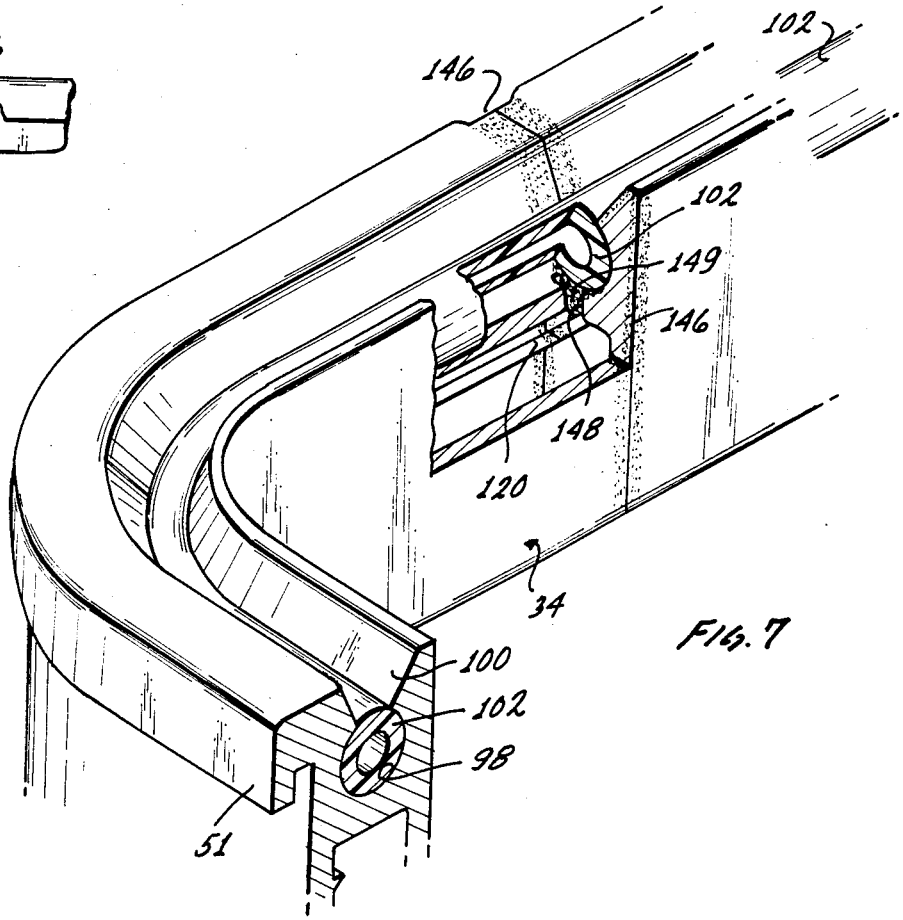
FIG. 7 shows a fragmented broken-away perspective view of the channel member at the weldment having the elastomeric O-ring or gasket sealed therein and a view of the sealant for the O-ring to prevent the passage of gas or air and moisture around the gasket; and, FIG. 8 shows a view of the hinge as expanded and engaged under the spline of the channel members in the direction of lines 8—8 of FIG. 2.

Looking more particularly at FIG. 7, it can be seen that the channel member 34 is shown with the tubular gasket 102 therein. As previously stated, the member 34 is an extruded metal member and must be welded. This weld takes place along line 146 at a weldment abutment. The weldment is such that it is impractical to penetrate into the base of the groove 98 that receives the gasket 102. As a consequence, in order to provide a seal at the weld point, one edge of the weld section is grooved, such as with a saw cut. This is shown as a groove 148 in one of the butting ends of the member to be welded. This groove 148 allows the non-hardening sealant 120 to flow upwardly through the groove 148 and be displaced around the O-ring or gasket 102. The sealant thus flows after the sealant has been displaced through the groove 148 as can be seen in the form of sealant 148 flowing therethrough into contact with the O-ring or gasket 102.

Any sealant can be utilized, so long as it flows in part around, against or in contact with the gasket 102.

As can be seen, the bending moment applied through the axis A—A causes the bottom portion 160 of the sheet to bend in the direction of arrow B toward the inside and apply a force back against tang or barb 80. Thus, the invention hereof covers both a method for gripping, securing and sealing as well as the product itself.

As previously mentioned, clamps or latches can be substituted entirely for the hinge 38. In this case an overcenter cam lock having a hooked tongue can be riveted to the side of the container 10. The hooked tongue can engage a channel or other protuberance on the opposite portion of the container. When the tongue is cammed into forced tightened engagement with a ledge, protuberance or channel of the opposite portion of the container, it forces the seal together so that tongue 106 engages seal 102 for sealed engaging relationship.

The foregoing inventions of this application including the holding and sealing means, the configuration of the hinge, the sealant for purposes of sealing the weld joint, and the other portions hereof, both singularly and in combination should be read broadly in light of the following claims.

I claim:

1. A system for maintaining one plastic wall in sealed relationship to another plastic wall of the type found in a container having at least two portions including a top and bottom that come together in closed relationship to form a closure comprising:

a first and second channel member for seating on the plastic walls of each respective first and second portion forming the top and bottom of said container that is to be sealed, wherein each of said channel members has a channel for receipt of the plastic wall in one portion thereof and another portion adapted to seat against the other channel member to provide a sealing relationship; and, said channel for receiving said plastic wall has at least one barb formed on each of said channel walls in displaced relationship along the depth of the channel from each other for bending said wall so that said wall is displaced through the axis thereof so as to be placed with a bending moment within said channel to cause said wall to move against one of said barbs in said channels to cause a cold flow of the plastic of said wall against one of said barbs.

2. The structure as claimed in claim 1 wherein said rspective barbs comprise:

at least one barb formed in an elongated manner at a lower portion within said channel; and, a plurality of barbs in an upper portion displaced away from said lower barb and on an opposite wall in order to provide a bending moment of said container plastic wall portion when implaced therein to create a cold flow of said container plastic wall against said first barb.

3. The structure as claimed in claim 2 further comprising:

a non-hardening sealant within said channel wherein said wall is implaced.

4. The structure as claimed in claim 3 further comprising:

a hinge connecting said first and second channel members so as to allow a hinging of the container to which it is attached;

a groove within one of said channel members having an elastomeric seal therein; and, a tongue in the other of said channel members adapted to be placed within the groove of said opposite channel member in an elongated sealing relationship so as to provide for a sealing to prevent the passage of moisture from the exterior to the interior of said container.

5. The structure as claimed in claim 4 further comprising:

flanges on the exterior portion of said channel members; and, openings within said hinge members adapted to be expanded and displaced into said areas overlapped by said flanges.

6. The structure as claimed in claim 5 wherein:

said channel members are formed from and extruded metallic member and are welded to provide a continuous looped configuration to be fit upon said container wall portions; and, at least one passage between said elastomeric seal and said sealant within the bottom of said channel to allow for passage of said sealant against said elastomeric member to seal it thereat in proximate relationship to the weldment of said channel members.

7. The process of providing a closure between two container portions having plastic walls for a sealed relationship therein comprising:

providing a first and second container portion for respective containment of an article to be placed in said first and second container portions when they are closed together;

providing a first and second channel member for respectively seating on the edge wall portions of said first and second container portions;

providing an interfacing sealing means between said first and second channel members when said channel members are implaced on said wall for sealing said container portions together;

providing at least one barb on one of the interior walls of said channel members, and a protuberance on the opposite wall; and, implacing said container wall portions respectively in said first and second channel members and displacing said wall portions by said protuberance and causing a bending moment thereof against said barb so that said plastic wall portion is secured therein and will impinge forceably against said barb to cause the plastic of said wall portion to cold flow with respect to said barb.

8. The process as claimed in claim 7 further comprising:

forming said container walls from high density polyethylene; and, providing a non-hardening sealant within the lower portions of said channel members between said channel walls.

9. The process as claimed in claim 8 further comprising:

providing at least one or more barbs in an elongated conformation on the interior wall of each of said channel members;

providing a plurality of barbs on the opposite wall displaced from said first barbs;

implacing said container wall within said space between said channel walls; and, crimping the wall with said plurality of elongated barbs thereon against said first barb so as to cause a displacment of the container wall portion through its structural axis thereby creating a bending moment and causing said container wall to move against said first barb.

10. The process as claimed in claim 9 further comprising:

providing said sealing means between said first and second channels for said container in the form of a tongue on one of said channel members and a groove on the other of said channel members for receiving said tongue; and, providing an elastomeric seal within the groove of said second channel member.

11. The process as claimed in claim 10 further comprising:

forming said channel members from a metal extrusion and bending and welding said channel member in a form to conform to said container wall;

providing a passage between said sealing groove and said channel of the channel member in which said elastomeric non-hardening sealant is provided; and, causing said non-hardening sealant to flow from said channel base through said passage against said elastomeric seal.

12. The process as claimed in claim 11 further comprising:

hinging or clamping said first and second channel members by means of flanges on the outside of said channel members; and, expanding said hinges into the flange areas of said first and second channel members.

13. The combination of a sealed container and a seal for opening and closing said container in a sealed relationship comprising:

a plastic walled container having a first and second portion which is adapted for hinging together in the form of a case;

hinge means for hinging said first and second container portion together;

a first channel implaced on a portion of said first portion and a second channel implaced on a portion of said second portion completely circumscribing the edge regions of said plastic container walls on the edges thereof;

a channel grove within said channel members adapted for placement on said container walls having a first barb in an elongated conformation within said channel; and, a protuberance on the opposite wall of said channel and means for displacing said container walls by said protuberance projecting against said container walls and driving said walls against said barb so as to create a bending moment within said walls and cause said plastic to cold flow around said barb and create a sealant therein.

14. The combination as claimed in claim 13 further comprising:

a non-drying sealant within each of said channels into which said wall portions of said container are seated;

a tongue and groove respectively of said channel members so that said channel members can be seated against each other through the tongue and groove; and, elastomeric sealing means in the form of an elastomeric gasket that is implaced within said groove for mating against said tongue for sealing thereof.

15. The structure as claimed in claim 14 further comprising:

said first and second channel members being formed as a continuous extrusion that has been welded; and, a groove proximate said weld points between said elastomeric gasket and said non-drying sealant to allow said sealant to flow against said elastomeric gasket to seal it proximate said weldment.

16. The structure as claimed in claim 15 wherein:

said first barb is formed with a face within the range of twenty to forty-five degrees; and, said means for displacing said protuberance thereagainst on the opposite wall is a crimped angular portion which displaces said container wall against said barb.

17. The structure as claimed in claim 16 comprising:

a respective pair of flanges on each of said channels; and, a hinge disposed between said channel members and connected by means of expanding said hinge into said flanges to interconnect the channel members.

18. The structure as claimed in claim 17 wherein:

said first barb is displaced within said channel at an unequal distance from said second protuberance; and wherein, said second protuberance is formed from at least one continuous barb or tang on the interior wall of said channel.

19. The structure as claimed in claim 18 further comprising:

a rounded groove for receipt of said elastomeric gasket having sloping walls leading thereinto so as to allow a placement of said elastomeric gasket between said walls and into said groove which receives it therein.

* * * * *